US006321576B1

(12) United States Patent
Barea

(10) Patent No.: US 6,321,576 B1
(45) Date of Patent: Nov. 27, 2001

(54) DEVICE FOR CONTROLLING YARN FEED TO A TEXTILE MACHINE AND METHOD FOR CONTROLLING THE MACHINE OPERATION AND PRODUCTION

(75) Inventor: Tiziano Barea, Busto Arsizio (IT)

(73) Assignee: B.T.S.R. International S.p.A., Olgiate Olona (IT)

( * ) Notice: Subject to any disclaimer, the term of this patent is extended or adjusted under 35 U.S.C. 154(b) by 0 days.

(21) Appl. No.: 09/267,956

(22) Filed: Mar. 12, 1999

(30) Foreign Application Priority Data

Apr. 17, 1998 (IT) ..... MI98A0817

(51) Int. Cl.[7] ..... D04B 15/48
(52) U.S. Cl. ..... 66/132 R; 66/146
(58) Field of Search ..... 66/125 R, 132 R, 66/132 T, 146; 242/365.7, 418, 418.1, 366.4

(56) References Cited

U.S. PATENT DOCUMENTS 3,858,416 1/1975 White et al. ..... 66/132 R
4,706,476 * 11/1987 Mimminger et al. ..... 66/132 R
4,752,044 * 6/1988 Memminger et al. ..... 242/47.01
5,174,133 * 12/1992 Kawase et al. ..... 66/57
5,323,625 * 6/1994 Paggiaro ..... 66/146
6,010,052 * 1/2000 Leins et al. ..... 226/44

FOREIGN PATENT DOCUMENTS 2012085 1/1971 (DE) .
3629699 3/1988 (DE) .
3824034 9/1989 (DE) .
2170627 9/1973 (FR) .
2162971 2/1986 (GB) .

* cited by examiner

*Primary Examiner*—Danny Worrell
(74) *Attorney, Agent, or Firm*—Steinberg & Raskin, P.C.

(57) ABSTRACT

A device (1) for controlling the feed of yarn (11) fed to a textile machine (10) such as a knitting machine, hosiery machine or a bobbin winder, comprises means (18) for ascertaining the yarn tension and means (3, 12) for measuring its feed velocity to the textile machine (10), said ascertainment and measurement being effected by evaluation and control means (20) which enable said tension and velocity values to be established with precision. A method implemented using the aforesaid device enables the evaluation and control means to control and regulate the operation of the textile machine (10) and for example the stitch length in a knitting or hosiery machine.

19 Claims, 2 Drawing Sheets

DEVICE FOR CONTROLLING YARN FEED TO A TEXTILE MACHINE AND METHOD FOR CONTROLLING THE MACHINE OPERATION AND PRODUCTION

FIELD OF THE INVENTION

This invention relates to a device able to measure and hence regulate and maintain at a constant level the tension with which a yarn is to be fed to a textile machine such as a knitting machine, a hosiery machine or a bobbin winding machine, said device being also able to precisely measure the velocity and hence the quantity of yarn fed to the machine. The invention also relates to a method for controlling a textile machine using the said device.

BACKGROUND OF THE INVENTION

Complex electrical/electronic sensors or devices for merely measuring the tension to which a yarn is subjected while being fed to a textile machine are known. Devices are also known which, on the basis of a set yarn tension and the measured yarn tension, control actuators acting on the yarn, to maintain said set tension constant with time independently of yarn velocity variations requested by the textile machine (low or high velocity) or of the variation in the tension of the yarn unwinding from a usual bobbin (between bobbin full and bobbin empty). Said devices, usually known as constant tension yarn feed devices, are hence able to feed a yarn to a textile machine with constant tension independently of any external factor, such as yarn velocity, yarn type, yarn unwinding irregularity, irregularity in yarn take-up by the machine, etc. These devices consequently also maintain this tension constant independently of the manner in which the textile machine is operated, the machine itself operating in accordance with a preset procedure, which is independent of the yarn tension control and regulation procedure.

In such textile machines and in particular in a knitting machine (for example a multi-feeder machine) it is also known to regulate the stitch length, usually by adjusting a simple screw acting on a cam (or equivalent mechanical member) operating with members such as needles or sinkers, in order to adjust the stroke of these to determine the length of the loop or stitch. In other words, the stitch length can be modified by regulating the spatial position of these stitch adjustment members. This adjustment is necessary because an error in stitch length adjustment even on only one of the feeders of the textile machine is known to cause a visual defect in the uniformity of the knitting produced. Moreover on article producing machines, such as hosiery or knitting machines with separation, a wrong length adjustment causes a variation in the size of the article produced, and hence a stocking or vest which may be longer or shorter, or wider or narrower.

A stitch length variation subsequent to its precise setting can be due to many reasons, for example a simple change in the temperature of the environment or of the textile machine itself, which starting from cold becomes increasingly hotter during operation, causes inevitable expansion or deformation of the materials used in the machine construction, and hence a more or less evident variation in the stitch length adjustment. Another cause is related to simple wear of the stitch formation and adjustment members (ie needles, sinkers and cams), which can lead to further variation in an adjusted stitch length. A further cause is related to variation in the tension or lubrication of the yarn fed to the textile machine, which can cause considerable variation in an adjusted stitch length.

Consequently the stitch length has to be carefully and periodically adjusted on all the feeders of all the textile machines present in the production unit, in order to "chase" any yarn take-up variations. However this adjustment is always made either directly or indirectly by a textile machine operator. The adjustment of the screw which acts on the cam operating the stitch members has already been mentioned. This adjustment can be made either by said operator or by a control unit (for example of microprocessor type) which controls the operation of the entire textile machine. In this respect, machines of modern design are known which use actuators of various kinds to adjust the stitch length or to vary it at will according to the production or the aesthetic effect desired. Said actuators are controlled by the control unit, which operates in the following manner. To correctly adjust all the feeders of the textile machine, devices able to measure the velocity with which each yarn is fed to the machine are normally used. In their most simple form, these devices are usually a wheel of known diameter and an r.p.m. counter therefor, to determine the yarn quantity (in meters per minute) absorbed by the machine. This quantity is suitably displayed, and on the basis of this reading the operator can adjust the parameters programmable by said unit, which consequently acts on the stitch adjustment actuators to obtain correct and precise alignment of all feeders.

Hence even in the case of machines controlled by a control unit as indicated, this provides its adjustment action on the stitch members only after the operator himself has set the operating parameters of the unit.

Finally, textile machine yarn feed devices are known which are able to feed the machine with one yarn at constant velocity per feeder. For example, knitting machines already comprise yarn feed devices able to feed the yarn at constant velocity for each feeder.

This is made possible, for example, by a plurality of rotary members (so-called "positive" feed devices) each cooperating with a corresponding yarn fed to a relative feeder. All these rotary members are rotated at the desired speed by a simple smooth or toothed belt driven by a pulley connected by a transmission shaft to the textile machine motor, by which all members are therefore driven. It is hence apparent that having established the correct ration between the textile machine motor and the rotary yarn feed members, when the machine r.p.m. varies a proportional variation in the speed of these members is obtained, to hence give a constant feed ratio.

However because of various problems (already described in relation to the stitch length), this feed ratio does not in reality remain constant with time, with consequent modification of the tension or feed velocity of each yarn to the machine and hence the production of defective articles.

Moreover, measuring a velocity without simultaneously maintaining the tension of the yarn fed to the textile machine constant results in a measurement which has no operational value. In this respect, for example, in an elastic yarn the higher its tension the greater is its elongation and the lower its velocity. Hence while measuring this latter, a variation in the yarn tension can result in an incorrect velocity measurement and hence an unnecessary or mistaken adjustment of the rotational speed of the rotary members (and of the textile machine), or no adjustment at all.

OBJECTS AND SUMMARY OF THE INVENTION

Consequently an object of the present invention is to provide an improved device for controlling a yarn fed to a textile machine.

A particular object of the invention is to provide a device of the said type which enables a yarn fed to a textile machine to be controlled and regulated such as to maintain both its tension and its feed velocity constant.

A further object is to provide a device of the said type which allows precise measurement of the quantity of yarn fed to a textile machine, in order for example to be able to rapidly and reliably calculate the yarn quantity used by it for production, and hence evaluate the true production costs.

A further object is to provide a device of compact form and dimensions enabling it to be used on any textile machine, and able to communicate along serial communication lines.

A further object is to provide a method for effectively and precisely controlling the operation of a textile machine, and in particular for controlling and regulating the stitch length of said machine either automatically without the intervention of any operation, or manually with the manual intervention of said operation.

A further object is to provide a method of the said type by means of which if one of two parameters, namely yarn tension and yarn feed velocity, is fixed and maintained constant, the other of these parameters can be regulated and maintained constant.

These and further objects which will be apparent to an expert of the art are attained by a device and method in accordance with the accompanying claims.

BRIEF DESCRIPTION OF THE DRAWINGS

The invention will be more apparent from the accompanying drawing, which is provided by way of non-limiting example and on which.

DETAILED DESCRIPTION OF THE PREFERRED EMBODIMENTS

Figure 1:
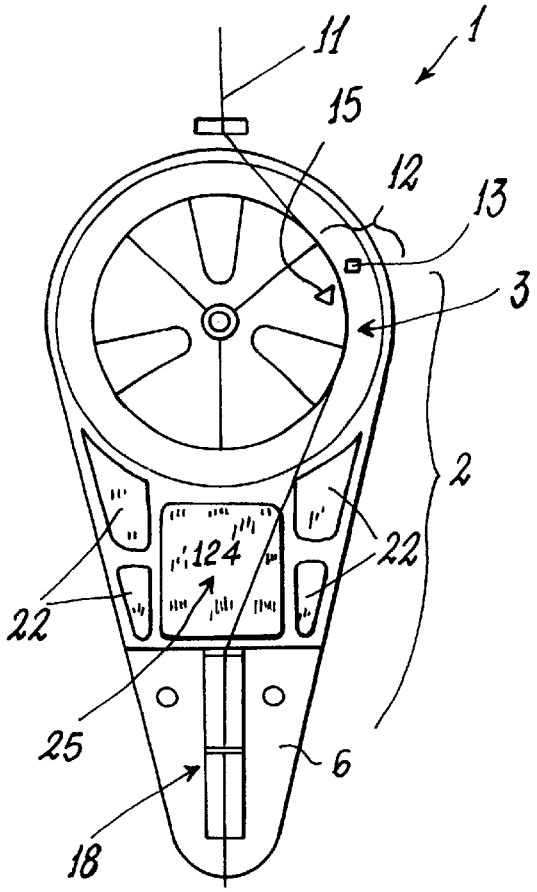
FIG. 1 is a front view of a device according to the invention.
Figure 2:
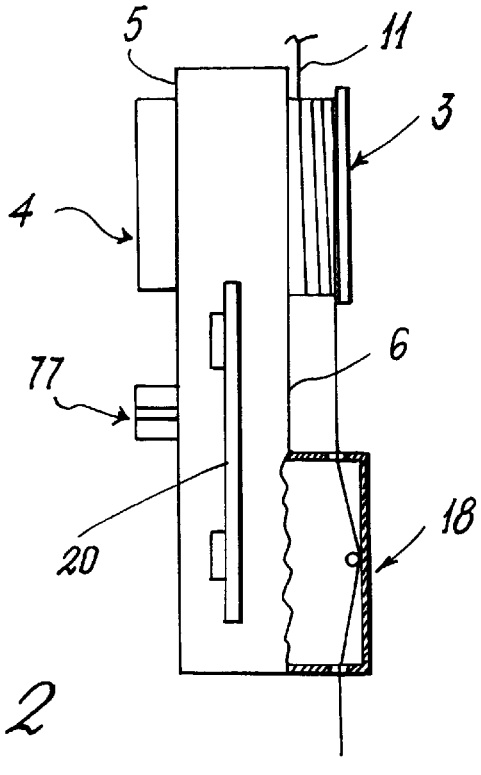
FIG. 2 is a side view of a device according to the invention.

With reference to said figures, and in particular to FIGS. 1 and 2, the device of the invention is indicated overall by 1 and comprises a casing 2 (for example of box structure). With this casing there is associated a grooved wheel or pulley 3 connected to an actuator 4 for its movement. This actuator can be an electric motor 4 (for example of brushless type) associated with that face 5 of the casing 2 opposite the face 6 on which the pulley 3 is present. Alternatively the pulley can be driven, via suitable transmissions in known manner, by the main motor of a textile machine 10 (see FIG. 4 in which this connection between the pulley and the machine motor is represented by the dashed line K) with which the device 1 is associated. In particular, a device of the invention is associated with each yarn 11 fed to the machine, said yarn unwinding from a bobbin B and winding one or more times about the pulley 3.

This pulley is directly or indirectly connected to a member 12 which senses its rotation and hence measures the speed of this rotation. This member can be a magnetic sensor 13 associated with the casing 2 and cooperating with a magnet 15 associated with the pulley, or a known Hall sensor associated with the motor 4 (brushless motor with Hall sensor incorporated).

The casing 2 also supports a member 18 for measuring the tension of the yarn 11 fed to the machine 10. This member is of known type and can comprise a usual magnetic sensor, a piezoelectric sensor, a load cell, an elastically supported arm or another known sensor.

The tension measuring member 18 and the pulley r.p.m. measuring member 13 are connected to a unit 20 for controlling and regulating the feed of the yarn 11 to the textile machine 10. Advantageously, the unit 20 is associated with the device 1 (by being inserted in its casing 2), and via the connection to said measuring members is able to correctly and precisely determine the quantity of yarn (in meters per minute) fed to the machine. This is achieved by using evaluation algorithms which take into account both the measured tension of the yarn 11 and the pulley r.p.m. In this respect, knowing the relationship which, in determining a yarn count (expressed in DENIER or DECITEX), exists between the yarn quantity in metres and its unit of weight, it is possible to calculate the exact weight of yarn, or quantity of yarn in terms of weight, fed to the textile machine (and used in the article manufacture) and hence the product cost. Usual setting members associated with the casing 2 are connected to the unit 20, for example of microprocessor type. These members are an interface keypad 22 or usual potentiometers 23 connected to said unit. This latter is also connected to a display 25 on which the unit 10 displays the data measured by it, such as the yarn feed velocity, the yarn quantity fed to the textile machine 10, its tension and other data which may be related to the yarn or to the unit itself (programmed tension and other unit programmable functions, alarms, etc.).

Figure 3:
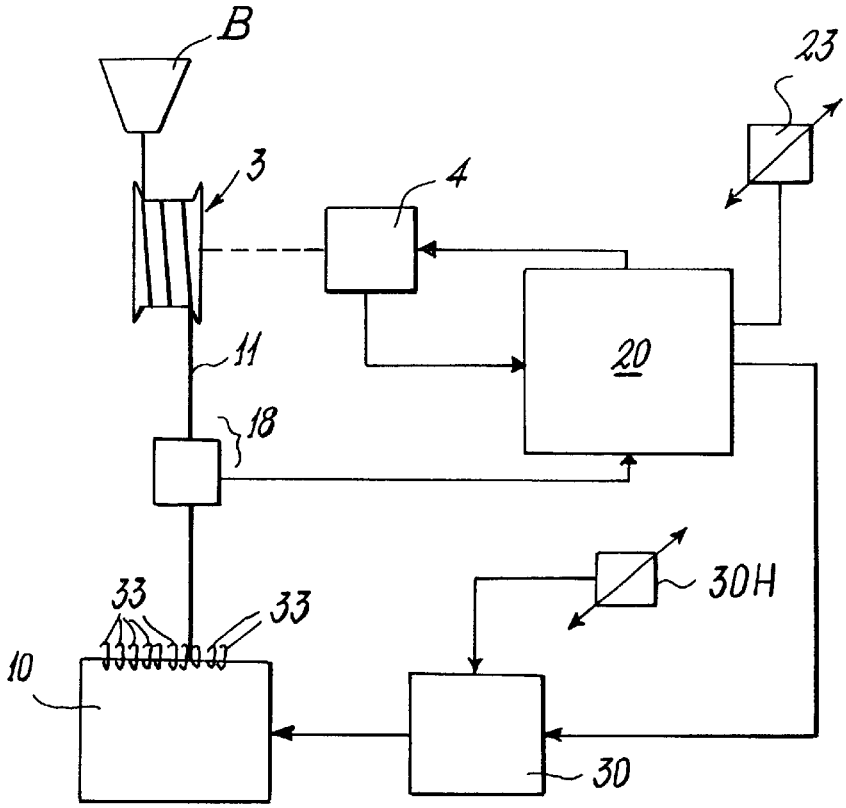
FIG. 3 is a block diagram of a first embodiment of the method of the invention.

The device 1 can be used in two ways. If used in a first manner it merely measures in a precise and efficient manner the true quantity of yarn fed to the textile machine and effectively processed thereby (for example the yarn wound on a bobbin). In this case, on the basis of the programmed tension and the measured yarn feed velocity, the unit 20 displays on the display 25 the number of metres of yarn fed to the machine per minute. This enables fast and very accurate calculations to be made regarding the cost of the finished product (for example a produced bobbin). If used in a second manner (see FIGS. 3 and 4), the device 1, by way of the connection between the unit 10 and a textile machine control unit 30 (also associated with setting members, such as a potentiometer 30H), enables the machine operation to be controlled correctly to obtain products without defects. For example in a knitting or hosiery machine, this control is achieved by action aimed at usual stitch formation members (such as needles 33), the spatial movement of which is indirectly obtained by known adjustment actuators acting on usual cams associated with said members or needles, in such a manner as to maintain the stitch length of the processed product constant.

In all cases the unit 20 generates an output signal (fed to the display 25 or to the unit 30 of the machine 10) which is a function of the velocity with which the yarn is fed to the machine 10 and which in any event depends on the measured and regulated tension. In the more simple case in which the device 1 is a device for counting the metres of yarn effectively fed to the machine 10, the unit 20 "weighs" the measured velocity value against the measured and regulated tension value or, on the basis of the value of this tension compared with a set value, determines the yarn velocity and hence, using comparison and correction algorithms for the measured data, determines the yarn quantity effectively fed to the textile machine. This overcomes those problems of measuring the quantity of an elastic yarn fed to a textile machine present in known devices for effecting this measurement independently of the yarn tension.

If the device 1 is used to regulate the stitch length in a textile machine, the invention provides "closed loop" control of the machine production process. In this respect, reference will firstly be made to FIG. 3.

This figure shows the method of the invention implemented with the aforedescribed device used for adjusting the stitch length on the basis of the yarn feed velocity measurement. From a usual yarn bobbin 12, the yarn 11 reaches the pulley 3 and forms one or more turns about it (to prevent the yarn slipping on the pulley 3). The yarn 11 is then fed to the tension sensor or measurement member 18 connected to the unit 20, which effects a precise measurement of said yarn tension. On the basis of this measurement, this unit automatically adjusts the yarn feed velocity to the machine 10 by controlling the motor 4 connected to the pulley 3. By means of this velocity adjustment the unit 10 maintains the tension of the yarn 11 constant at the set value keyed in via the relative interface keypad 22. The unit 20 then accurately measures the velocity with which the yarn is fed to the textile machine and feeds a control signal to the unit 30, which acts on the textile machine 10. The unit 30 acts via usual actuators, either its own or those applied to the textile machine (for example stepping motors), on the stitch forming members (cams, needles or sinkers). Hence by controlling said actuators on the basis of the measured and set velocities, the unit 30 maintains this yarn feed velocity constant with time, by increasing the stitch length if the measured velocity is less than the set velocity. If the measured velocity is greater than the set velocity, the stitch length is decreased.

Figure 4:
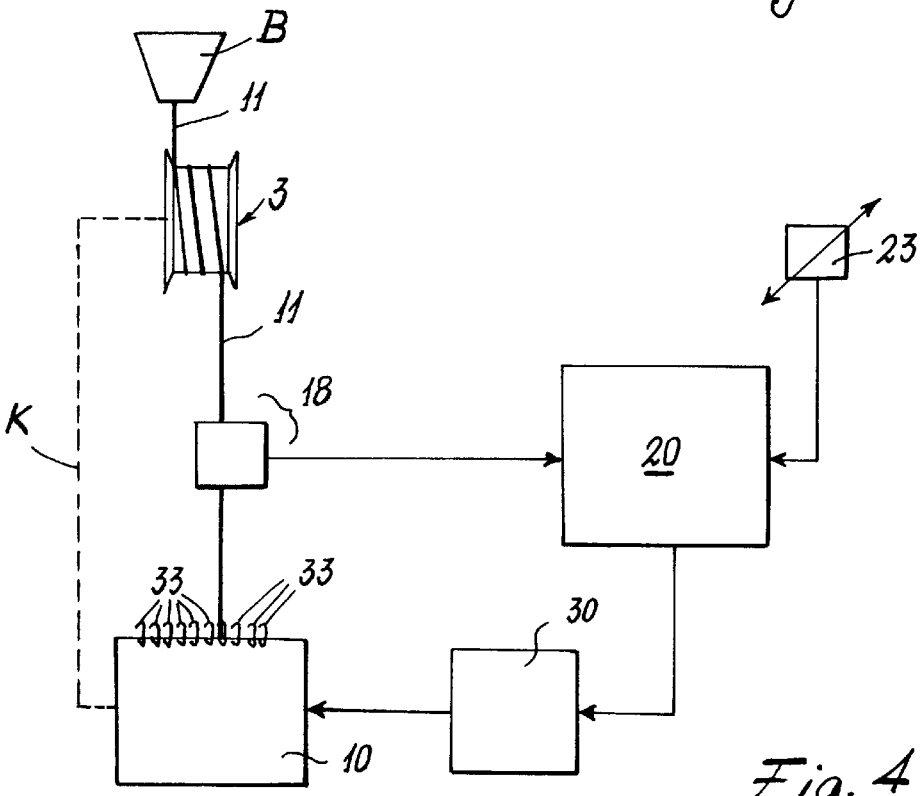
FIG. 4 is a block diagram of a second embodiment of the method of the invention.

In contrast, FIG. 4 shows the method used for adjusting the stitch length on the basis of the measured yarn tension. In this figure the yarn 11 is fed to the pulley 3 (in the example, mechanically ratioed via suitable reduction gears to the main textile machine motor) so that on varying the machine speed, the yarn feed velocity varies proportionally. The yarn 11 is then fed to the tension sensor 18 and then to the textile machine. Said sensor is connected to the control unit 20 and enables it to know the precise tension to which the yarn is subjected, on the basis of the set tension and the tension effectively measured by the sensor 18. The control unit 20 then gives the textile machine control unit 30 information regarding the error in the measured tension, on the basis of which the unit 30 acts on the stitch forming members 33 via the said actuators, to compensate for any variations in the measured tension by maintaining this latter constant, to hence achieve automatic adjustment of the stitch length as desired. This adjustment occurs by decreasing the stitch length if the measured tension is greater than the set tension, and by increasing the stitch length if the measured tension is less than the set tension.

Hence in the aforesaid cases, on the basis of one yarn feed parameter (tension or velocity) maintained constant at a desired value, the operating members (needles or sinkers) of the textile machine 10 can be acted upon in such a manner as to also maintain the other parameter (velocity or tension) constant. In this manner the finished article (for example a vest or a stocking) presents reliable and defined quality and length characteristics which are constant for the entire product. In other words, the device of the invention implements a closed loop control method for a textile machine, which operates on every processed yarn in a constant and desired manner, to hence produce articles of constant quality. Instead of the unit 30, this control loop for the textile machine can comprise intervention by an operator who operates the actuators of the machine operating members.

It should also be noted that the velocity sensor 12 and the tension sensor 18 can be connected to the yarn feed control unit 20 via serial communication. For this purpose the device 1 comprises a serial communication port 77. Serial communication can also be provided between the unit 20 and the unit 30 which oversees the textile machine operation.

In the example, this latter has been described as a knitting or hosiery machine. However it can be any yarn processing machine, such as a bobbin winder or another machine. In this case the constancy of the final product (for example a bobbin) is always controlled and maintained via the continuous control of yarn feed parameters, ie its tension and velocity.

Various embodiments of the invention have been described. Others are however possible, for example the motor 4 of the device 1 could be driven by another known electric motor, for example a stepping motor etc. These variants are also to be considered as falling within the scope of the present document.

What is claimed is:

1. An arrangement of a textile machine and a device for controlling a feed of a yarn (11) fed to said textile machine (10), said yarn having a tension and a velocity, said device for controlling the feed of said yarn having a control unit (36) acting on adjustment actuators which operate on stitch forming members (33), said device comprising means (18) for ascertaining a first yarn parameter between said tension and said velocity and measuring means (3, 12) for measuring a second yarn parameter between said tension and said velocity, said ascertaining means (18) and measuring means (3, 12) are both operatively coupled to a casing (2) of the device (1) and are both connected to controlling and regulating means (20) for controlling and regulating said first and second parameters, said control and regulating means (20) continuously measuring values of both said parameters during the feed of the yarn (11) to the textile machine and comparing at least a first of these parameters with a predetermined homogeneous value and regulating said first parameter so as to maintain it constant, said controlling and regulating means (20) being connected to the textile machine control unit (30), the control unit (30) acting on the stitch forming members (33) via said adjustment actuators on the basis of the controlled second parameter value detected by the controlling and regulating means (20) in order to regulate the value of the second parameter, the controlling and regulating means (20) and the textile machine control unit (30) providing closed-loop control of a machine production process.

2. An arrangement as claimed in claim 1, wherein the tension ascertaining means (18) is at least one of a load cell, a magnetic sensor, a piezoelectric sensor and an elastically loaded arm for sensing only the yarn tension.

3. An arrangement as claimed in claim 1, wherein said means for measuring said second yarn parameter between said tension and said velocity (12) comprises a rotary member (3) operatively coupled to said device casing (2) and about which the fed yarn (11) winds through at least one turn, said rotary member (3) operationally cooperating with means (12) for sensing a revolution per minute (r.p.m.) of said rotary member (3).

4. An arrangement as claimed in claim 3, wherein the sensing means for sensing said revolution per minute of said rotary member (3) comprises a measuring part (13) fixed on the device casing (2) and a moving part (15) connected to the rotary member (3).

5. An arrangement as claimed in claim 3, wherein the means for measuring said velocity (12) is operatively coupled to motor means (4) which is operatively connected to said rotary member (3) to thereby enable the velocity of the fed yarn (11) to be modified on the basis of the ascertained tension.

6. An arrangement as claimed in claim 5, wherein the motor means is an electric motor (4) mounted to the device casing (2), said motor means being operatively connected to said means for sensing said revolution per minute of said rotary member (3).

7. An arrangement as claimed in claim 6, wherein the means for sensing said revolution per minute of said rotary member (3) is at least one Hall sensor.

8. An arrangement as claimed in claim 5, wherein the motor means is a textile machine motor, to which the rotary member (3) is connected via a mechanical transmission member.

9. An arrangement as claimed in claim 5, wherein the motor means (4) is operatively connected to a control means (20).

10. An arrangement as claimed in claim 9, wherein the control means (20) is a microprocessor unit.

11. An arrangement as claimed in claim 10, wherein the control means (20) is separate from the device casing (2) and is operatively connected to the ascertaining means (18) and means for measuring said velocity either directly or via a serial communication line.

12. An arrangement as claimed in claim 10, wherein the control means (20) is inserted in the casing (2) of the device (1).

13. An arrangement as claimed in claim 11, wherein the control means (20) and the textile machine control member (30) are connected together either directly or via a serial communication line.

14. A device as claimed in claim 1, characterised in that an interface for the control and regulating means (20) is provided on the casing (2), said interface comprising a keypad (22) and a display.

15. A method for controlling a feed of a yarn (11) fed to a textile machine (10) and implemented by an arrangement comprising the textile machine (10) and a device for controlling said feeding of the yarn, said device for controlling said feeding having its own intrinsic tension and being fed at its own intrinsic velocity to said textile machine (10), the device comprising means (18) for ascertaining said intrinsic tension and means (3, 12) for measuring said velocity, said method comprising the steps of:

continuously measuring said tension of the yarn (11) fed to said machine (10);

continuously measuring a feed velocity of the yarn (11) fed to said machine (10);

comparing at least one of said tension and said feed velocity with at least one predetermined corresponding value;

evaluating any difference between the actual measured value and said predetermined value;

regulating said one of said tension and said feed velocity so as to be maintained constant;

then on the basis of said regulation of said one of said tension and said feed velocity, intervening on the part of the textile machine, on the basis of the at least one predetermined value of an other of said tension and said feed velocity, to thereby cause the machine (10) to modify the manner in which the yarn (11) is processed so as to modify the actual value of said other of said tension and said feed velocity in order to regulate it to a desired value;

calculating on the basis of said evaluation, a value of the nonmeasured one of said tension and feed velocity and regulating the value of said nonmeasured one of said tension and feed velocity to maintain it constant.

16. A method for controlling yarn feed as claimed in claim 15, wherein said controlling step comprises controlling one of a knitting machine and hosiery machine, wherein the intervention on the part of the textile machine is made on an actuator of a stitch forming member is controlled in such a manner as to make a stitch length constant.

17. A device as claimed in claim 1, wherein said textile machine (10) is one of a knitting machine, a hosiery machine and a bobbin winder.

18. An arrangement as claimed in claim 1, wherein an interface for the control and regulating means (20) is provided on the casing (2), said interface comprising a keypad (22) and a display.

19. An arrangement as claimed in claim 1, wherein the ascertaining means (18) and measuring means (3, 12) are operatively connected to the casing (2) of the device (1).

* * * * *